US012421748B2

(12) United States Patent
Reski

(10) Patent No.: US 12,421,748 B2
(45) Date of Patent: Sep. 23, 2025

(54) FLEXIBLE CABLE GUIDE LINK ASSEMLBY FOR A HINGED TOWER

(71) Applicant: Great Plains Towers, Inc., West Fargo, ND (US)

(72) Inventor: Kevin Reski, West Fargo, ND (US)

( * ) Notice: Subject to any disclaimer, the term of this patent is extended or adjusted under 35 U.S.C. 154(b) by 275 days.

(21) Appl. No.: 18/323,290

(22) Filed: May 24, 2023

(65) Prior Publication Data

US 2024/0052668 A1 Feb. 15, 2024

Related U.S. Application Data

(63) Continuation-in-part of application No. 17/818,882, filed on Aug. 10, 2022, now Pat. No. 11,613,902.

(51) Int. Cl.

| | |
|---|---|
| ***E04H 12/08*** | (2006.01) |
| ***E02D 27/42*** | (2006.01) |
| ***E04H 12/10*** | (2006.01) |
| ***E04H 12/18*** | (2006.01) |
| ***E04H 12/22*** | (2006.01) |
| ***E04H 12/34*** | (2006.01) |

(52) U.S. Cl.

CPC ..... *E04H 12/08* (2013.01); *E02D 27/42* (2013.01); *E04H 12/10* (2013.01); *E04H 12/187* (2013.01); *E04H 12/2261* (2013.01); *E04H 12/345* (2013.01)

(58) Field of Classification Search

CPC ..... E04H 12/08; E04H 12/10; E04H 12/187; E04H 12/2261; E04H 12/345; E04H 5/00; E04H 12/18; E02D 27/42; B65H 57/26; B65H 57/16; B65H 57/02

USPC ..... 242/615.3, 157 R

See application file for complete search history.

(56) References Cited

U.S. PATENT DOCUMENTS

| | | | | | |
|---|---|---|---|---|---|
| 2,213,870 | A * | 9/1940 | Scholl | E04H 12/187 | 52/125.2 |
| 2,577,811 | A * | 12/1951 | Rutledge | F21V 21/36 | 16/319 |
| 2,804,950 | A * | 9/1957 | Leslie, Jr. | E04H 12/187 | 52/646 |
| 2,875,865 | A * | 3/1959 | Rohn | H01Q 1/1235 | 52/646 |
| 4,571,450 | A * | 2/1986 | Duffy | H01B 7/282 | 174/106 SC |
| 6,164,803 | A * | 12/2000 | Reniger | F21V 21/06 | 362/477 |
| 7,621,078 | B2 * | 11/2009 | Phelan | F16G 13/20 | 52/118 |
| 9,249,595 | B1 | 2/2016 | Reski | | |
| 2005/0166485 | A1 * | 8/2005 | Sugimoto | B24C 1/10 | 52/155 |
| 2014/0360754 | A1 * | 12/2014 | Walton | F16C 5/00 | 174/86 |
| 2018/0231224 | A1 * | 8/2018 | Pannekoek | F21S 8/088 | |

(Continued)

*Primary Examiner* — Brent W Herring

(74) *Attorney, Agent, or Firm* — Fargo Patent & Business Law; Thomas Kading; Joshua Krank

(57) ABSTRACT

A tower includes a base section; a tower section hinged to the base section; a hinge assembly between the base section and the tower section, the hinge assembly defines a hinge axis about which the tower section hinges relative to the base section; and a flexible cable guide link assembly attached to the tower section such that the flexible cable guide link assembly extends across the hinge axis and into the base section.

14 Claims, 7 Drawing Sheets

(56) References Cited

U.S. PATENT DOCUMENTS

| | | | | |
|---|---|---|---|---|
| 2022/0145964 | A1* | 5/2022 | Hermey | F16L 3/015 |
| 2023/0358069 | A1* | 11/2023 | Anderson | F16C 11/04 |
| 2024/0175285 | A1* | 5/2024 | Connolly | E04H 12/18 |

* cited by examiner

FIG. 5
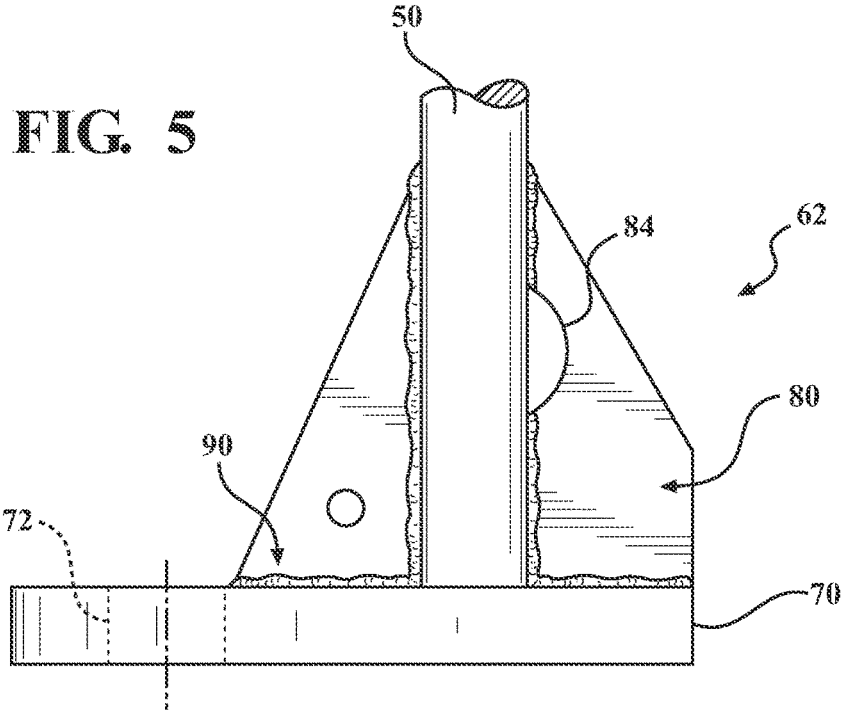
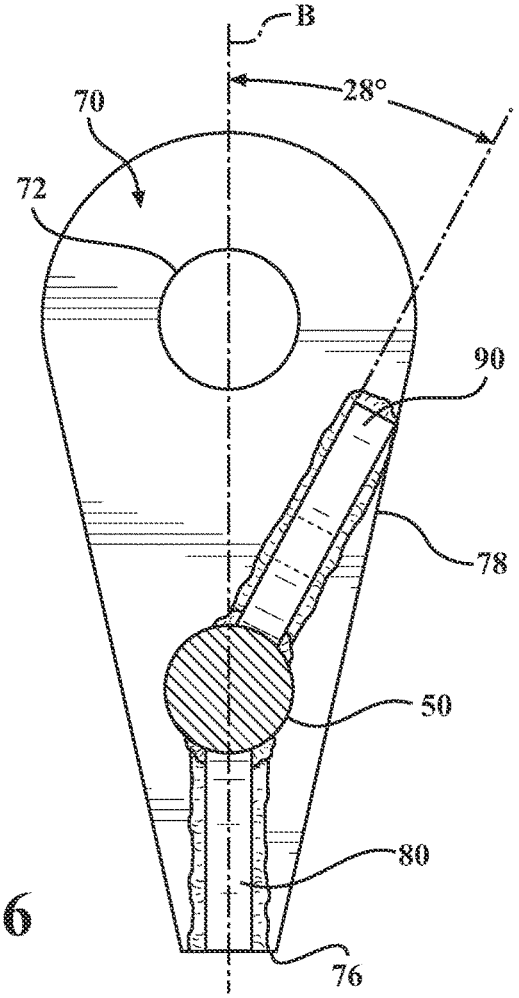
FIG. 6

FLEXIBLE CABLE GUIDE LINK ASSEMLBY FOR A HINGED TOWER

The present disclosure is a continuation-in-part of U.S. patent application Ser. No. 17/818,882 filed Aug. 10, 2022, which issued as U.S. Pat. No. 11,613,902 on Mar. 28, 2023.

BACKGROUND

The present disclosure relates to hinged towers, and more particularly to a cable guide therefor.

Equipment such as antennas, cameras, and the like are often mounted on towers to provide optimal operating positions. When the mounted equipment needs servicing or maintenance, service personnel typically must use an aerial lift, climb the tower, or lower the tower to the ground using a crane. Some towers are pivotable to facilitate access to equipment mounted thereon. As numerous cables extend across the hinge to the equipment, chaffing issues may be of concern.

SUMMARY

A tower according to one disclosed non-limiting embodiment of the present disclosure includes a base section; a tower section hinged to the base section; a hinge assembly between the base section and the tower section, the hinge assembly defines a hinge axis about which the tower section hinges relative to the base section; and a flexible cable guide link assembly attached to the tower section such that the flexible cable guide link assembly extends across the hinge axis and into the base section.

A further embodiment of any of the foregoing embodiments includes wherein the base section comprises a base lattice section that comprises a first leg, a second leg, and a third leg forming a triangular shaped base lattice section of the tower, the first, second and third leg each constructed of a galvanized steel; the tower section comprises a tower lattice section hinged to the base lattice section, wherein the tower lattice section comprises a first, second and third leg each constructed of an aluminum; a foot welded to each leg of the base lattice section, each foot having an aperture; an inner gusset welded to each foot and the respective leg, the inner gusset extends toward an inner edge of the respective foot; and an outer gusset welded to each foot, the outer gusset extends toward the aperture of the respective foot.

A further embodiment of any of the foregoing embodiments includes that each outer gusset defines an angle with respect to an axis defined between a center of the aperture and a center of the respective leg.

A further embodiment of any of the foregoing embodiments includes that the outer gusset extends outward toward the aperture.

A further embodiment of any of the foregoing embodiments includes that the outer gusset defines an angle with respect to the axis.

A further embodiment of any of the foregoing embodiments includes that the outer gusset defines an angle with respect to the axis.

A further embodiment of any of the foregoing embodiments includes that the angle is 28 degrees.

A further embodiment of any of the foregoing embodiments includes that the outer gusset extends for a length greater than the inner gusset with respect to the leg.

A further embodiment of any of the foregoing embodiments includes that the flexible cable guide link assembly is manufactured of a non-metallic material.

A further embodiment of any of the foregoing embodiments includes at least one cable that is routed through the flexible cable guide link assembly.

A further embodiment of any of the foregoing embodiments includes a piece of equipment mounted to the tower lattice section, the at least one cable routed to the piece of equipment.

A further embodiment of any of the foregoing embodiments includes a top mast section mounted to the tower lattice section, the piece of equipment mounted to the top mast section.

A tower according to one disclosed non-limiting embodiment of the present disclosure includes a base lattice section that comprises a first leg, a second leg, and a third leg forming a triangular shaped base lattice section of the tower, the first, second and third leg each constructed of galvanized steel; a tower lattice section hinged to the base lattice section, wherein the tower lattice section comprises a first, second and third leg each constructed of aluminum; a hinge assembly between the base lattice section and the tower lattice section, the hinge assembly defines a hinge axis about which the tower lattice section hinges relative to the base lattice section; a flexible cable guide link assembly attached to the tower lattice section such that the flexible cable guide link assembly extends across the hinge axis and into the base lattice section, wherein the flexible cable guide link assembly is manufactured of a non-metallic material; a top mast section mounted to the tower lattice section; a piece of equipment mounted to the top mast section; and a cable routed to the piece of equipment through the flexible cable guide link assembly.

A further embodiment of any of the foregoing embodiments includes a foot welded to each leg of the base lattice section, each foot having an aperture; an inner gusset welded to each foot and the respective leg, the inner gusset extends toward an inner edge of the respective foot; and an outer gusset welded to each foot, the outer gusset extends toward the aperture of the respective foot.

A further embodiment of any of the foregoing embodiments includes that the flexible cable guide link assembly is attached to the tower lattice section at a first horizontal above the axis of the hinge assembly.

The foregoing features and elements may be combined in various combinations without exclusivity, unless expressly indicated otherwise. These features and elements as well as the operation thereof will become more apparent in light of the following description and the accompanying drawings. It should be appreciated that however the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows:

FIG. 5 is a side view of a base flange assembly according to a disclosed non-limiting embodiment.

FIG. 6 is a top view of the base flange assembly of FIG. 5.

DETAILED DESCRIPTION

Figure 1:
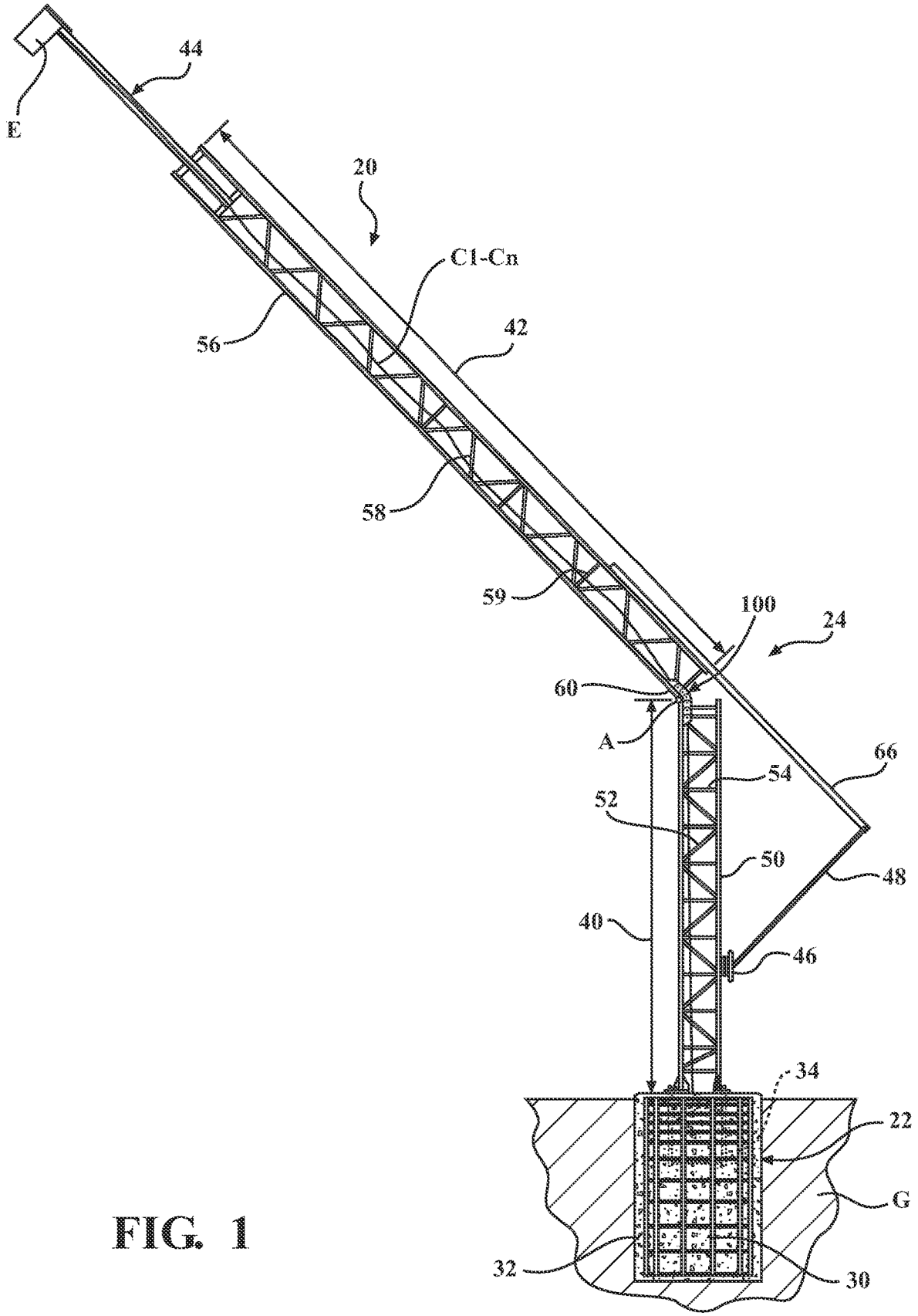
FIG. 1 is a perspective view of a hinged lattice tower structure according to one disclosed non-limiting embodiment.

FIG. 1 schematically illustrates a hinged lattice tower structure 20 that is utilized to erect various instruments. Although a hinged lattice tower structure 20 is illustrated in the disclosed embodiment, it should be appreciated that any hinged tower, pole, etc., will benefit herefrom.

The hinged lattice tower structure 20 generally includes a pier 22 that is located in the ground G to support a hinged lattice tower 24. The pier 22 is typically manufactured primarily of a non-metallic concrete material while the hinged lattice tower 24 is manufactured primarily of metallic materials.

Figure 2:
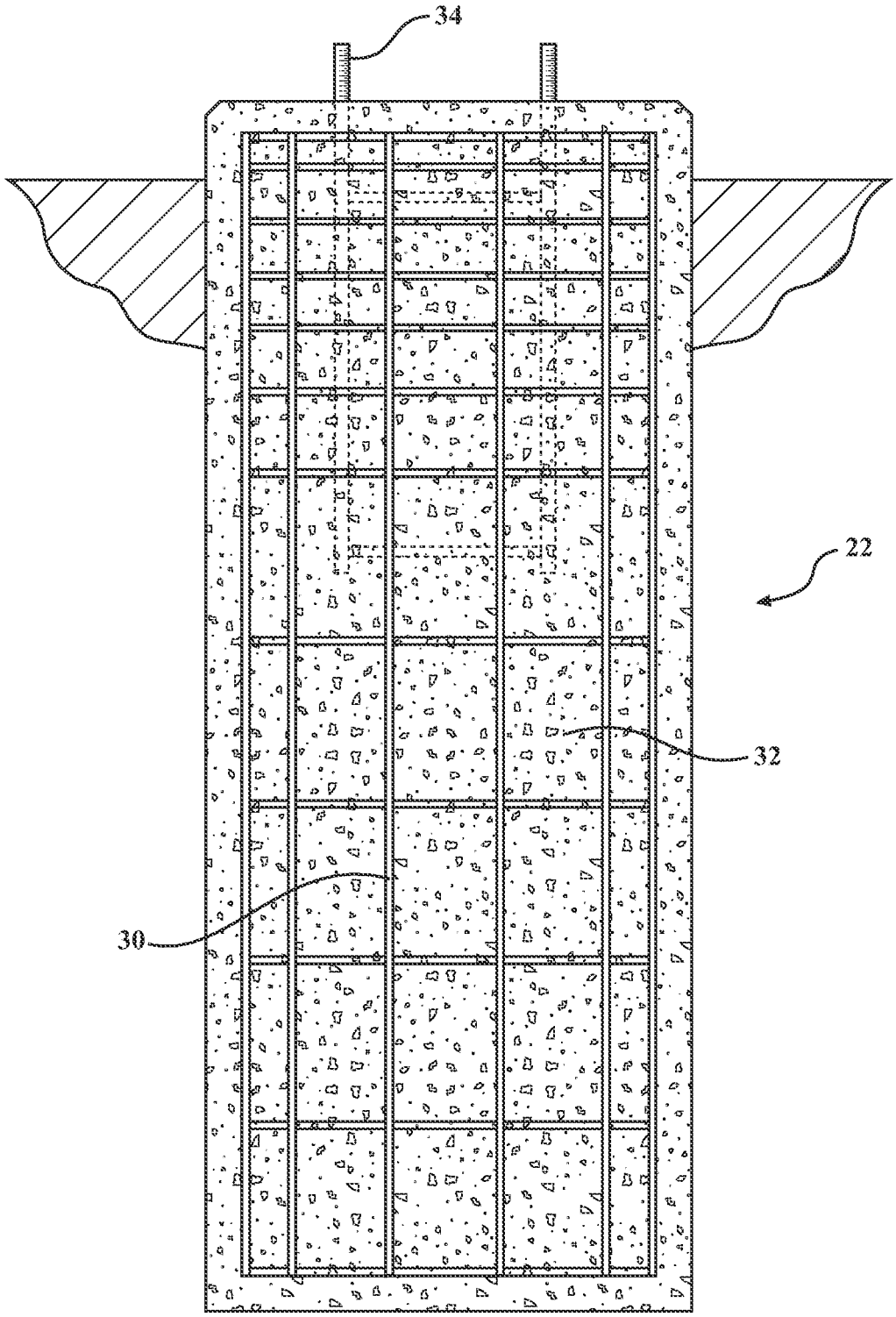
FIG. 2 is a perspective view of a pier for the hinged lattice tower structure according to a disclosed non-limiting embodiment.

In one embodiment, the pier 22 generally includes a rebar support structure 30 that reinforces the concrete material 32 to stabilize and support a cluster of three anchor base bolts 34 (FIG. 2). In one example, the concrete material 32 may be 4000 PSI minimum compressive strength concrete while the cluster of three anchor base bolts 34 may include 4 foot long, 1 inch diameter bolts.

The hinged lattice tower 24 may be assembled from a multiple of sections such as a base lattice section 40, a tower lattice section 42, and a top mast section 44. It should be appreciated that any number of sections may benefit herefrom. In one embodiment, the base lattice section 40 may be manufactured of an all galvanized steel while the tower lattice section 42 may be manufactured of aluminum. In this embodiment, the base lattice section 40 is 10 feet tall, the tower lattice section 42 is 20 feet tall and the top mast section 44 is 5 feet tall, however, other hinged lattice towers of other heights and configurations will also benefit herefrom.

The base lattice section 40 may be of an all welded construction utilizing 1018 minimum strength 1 inch diameter SR hot dipped galvanized steel legs 50 with 1018 minimum strength 0.5 inch diameter SR hot dipped galvanized steel diagonals 52 and horizontals 54. The legs 50, diagonals 52 and horizontals 54 may be solid steel. In one embodiment, the legs 50 are arranged in a triangular pattern.

The tower lattice section 42 may be of an all welded construction utilizing 6061 T6 1 inch aluminum round legs 56 with 6061 T6 ⅝" aluminum solid rod diagonals 58 and horizontals 59. The legs 56, diagonals 58 and horizontals 59 may be solid aluminum. In one embodiment, the legs 56 are arranged in a triangular pattern.

A hinge assembly 60 is mounted to the base lattice section 40 and the tower lattice section 42 such that the tower lattice section 42 is foldable, e.g., tiltable, pivotable, hingeable, etc., about a pivot axis A formed by the hinge assembly 60 between one or more tilted positions whereby the tower lattice section 42 is non-parallel to the base lattice section 40.

A winch 46 is mounted to the base lattice section 40 to deploy and retract a cable 48 that is attached to a raising and lowering arm 66 that extends from the tower lattice section 42. The winch 46 may include any appropriate locking mechanism that may be manipulated by the operator to temporarily prevent or at least reduce the likelihood of the rotation of a crank to maintain the tower in a desired position. One or more ratcheting mechanisms may also be used in relation to the winch. The raising and lowering arm 66 provides a mechanical advantage to the movement of the tower lattice section 42 with respect to the base lattice section 40.

Figure 3:
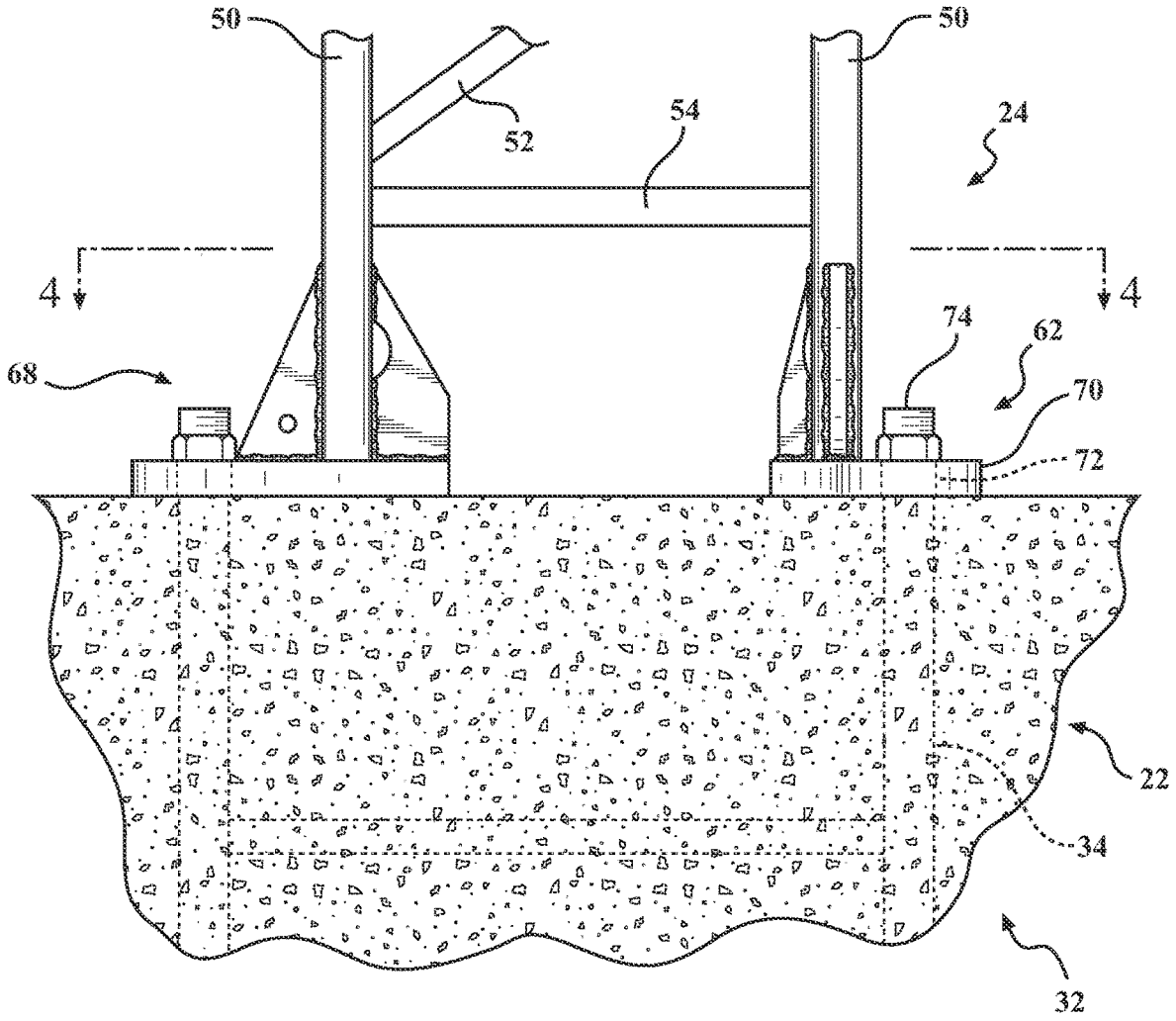
FIG. 3 is an expanded sectional view of a base assembly for the hinged lattice tower structure according to a disclosed non-limiting embodiment.

With reference to FIG. 3, the hinged lattice tower 24 is fastened to the pier 22 via a base assembly 68 that receives the three anchor base bolts 34. The base assembly 68 of the base lattice section 40 includes a base flange assembly 62 on each of the three legs 50. Each base flange assembly 62 includes a foot 70 with an aperture 72 to receive the anchor base bolts 34 which is then retained with a nut 74.

Figure 4:
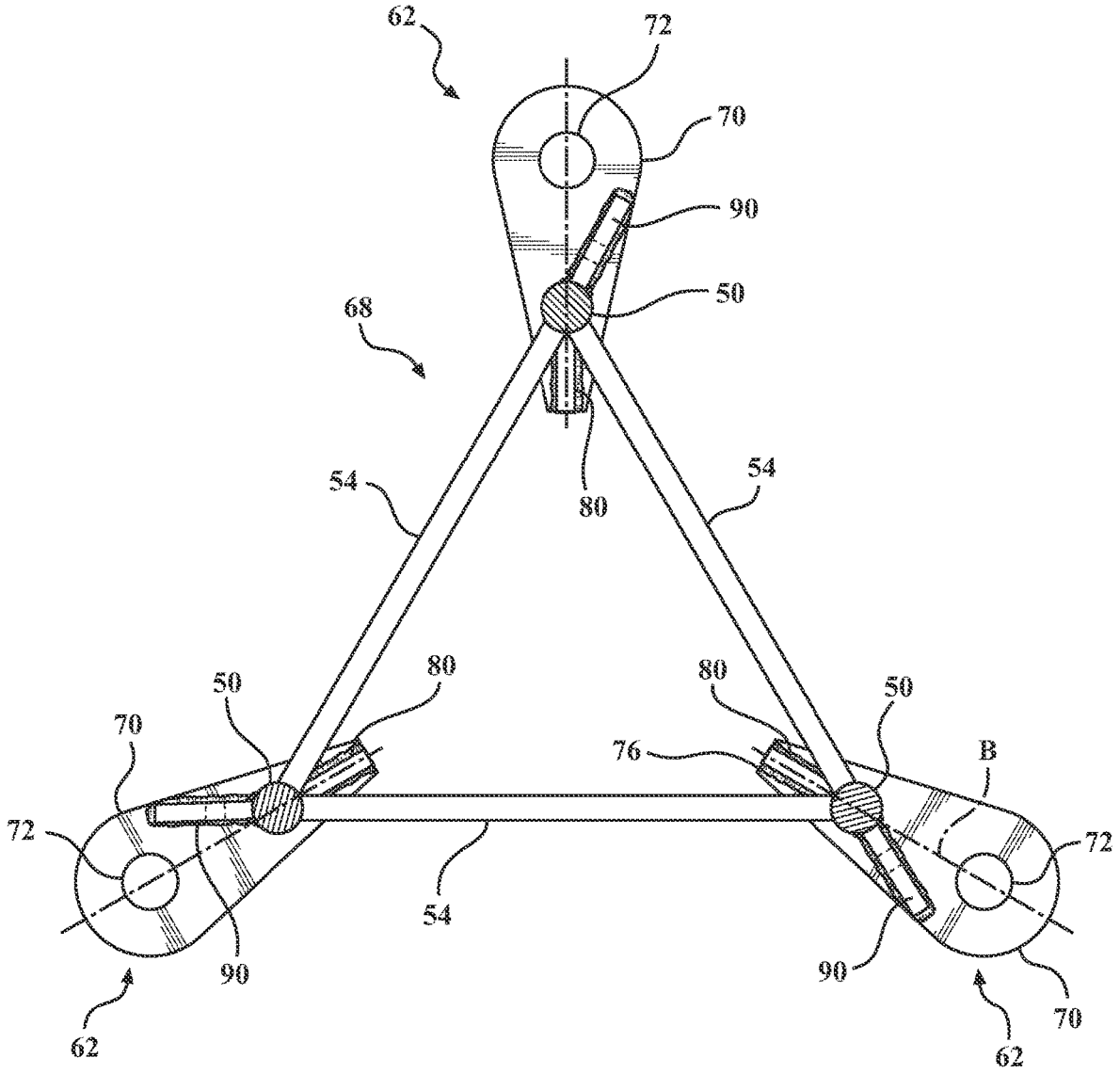
FIG. 4 is a top view of the base assembly.

With reference to FIG. 4, each base flange assembly 62 includes an inner gusset 80 and an outer gusset 90 that are both welded to the foot 70 and the respective leg 50 (FIG. 5). The inner gusset 80 includes a notch 84 that permits welding of the horizontals 54 to the leg 50. The inner gusset 80 is located between the two horizontals 54 that are welded to the leg 50 and extend to an inner edge 76 of the foot 70. In one example, the inner gusset 80 extends 1.625 inches from the leg 50 to the inner edge 76 of the foot 70 along an axis B that is defined between the centers of the aperture 72 and the leg 50.

The outer gusset 90 extends outward toward the aperture 72. The outer gusset 90 in this embodiment defines an angle with respect to axis B of 28 degrees (FIG. 6). In one example, the outer gusset 90 extends 2.0 inches to an outer edge 78 of the foot. The outer gusset 90 essentially extends the horizontals 54 to provide a further interface with the foot 70.

Figure 7:
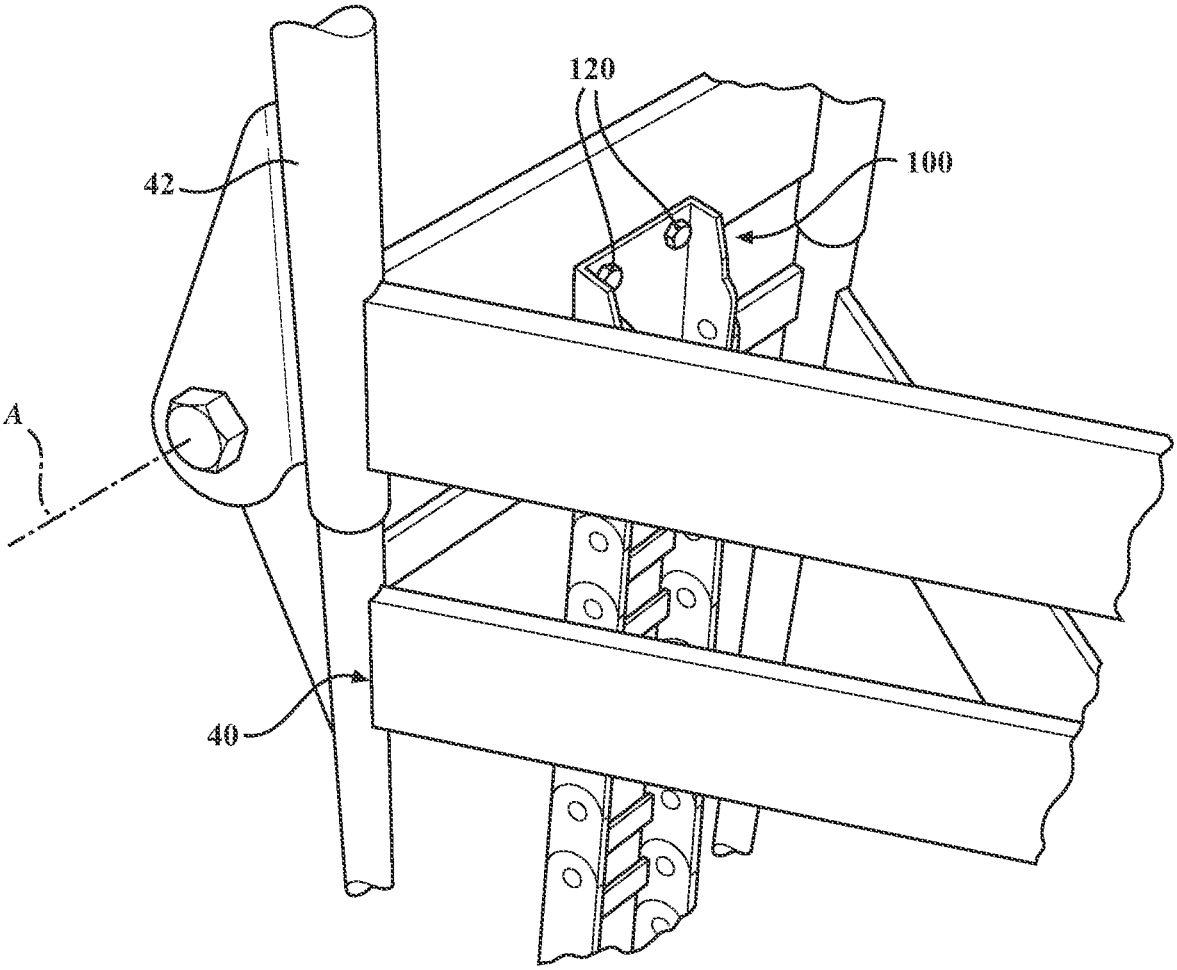
FIG. 7 is a perspective view of a hinged lattice tower structure according to another disclosed non-limiting embodiment with a flexible cable guide link assembly.

With reference back to FIG. 1 and to FIG. 7, in another embodiment, one or more cables C1-Cn extend from the pier 22 up through the base lattice section 40 across the hinge assembly 60 and thence through the tower lattice section 42 to the equipment E such as antennas, cameras, and the like mounted to the top mast section 44 (FIG. 1). The hinge assembly 60 defines an axis A between the tower lattice section 42 and the base lattice section 40.

A flexible cable guide link assembly 100 extends across axis A of the hinge assembly 60 between the base lattice section 40 and the tower lattice section 42. In this embodiment, the flexible cable guide link assembly 100 is attached to the tower lattice section 42 via fasteners 120 such as bolts, and essentially hangs freely across the hinge assembly 60 into the base lattice section 40 to receive and route the one or more cables C1-Cn (FIG. 1).

Figure 8:
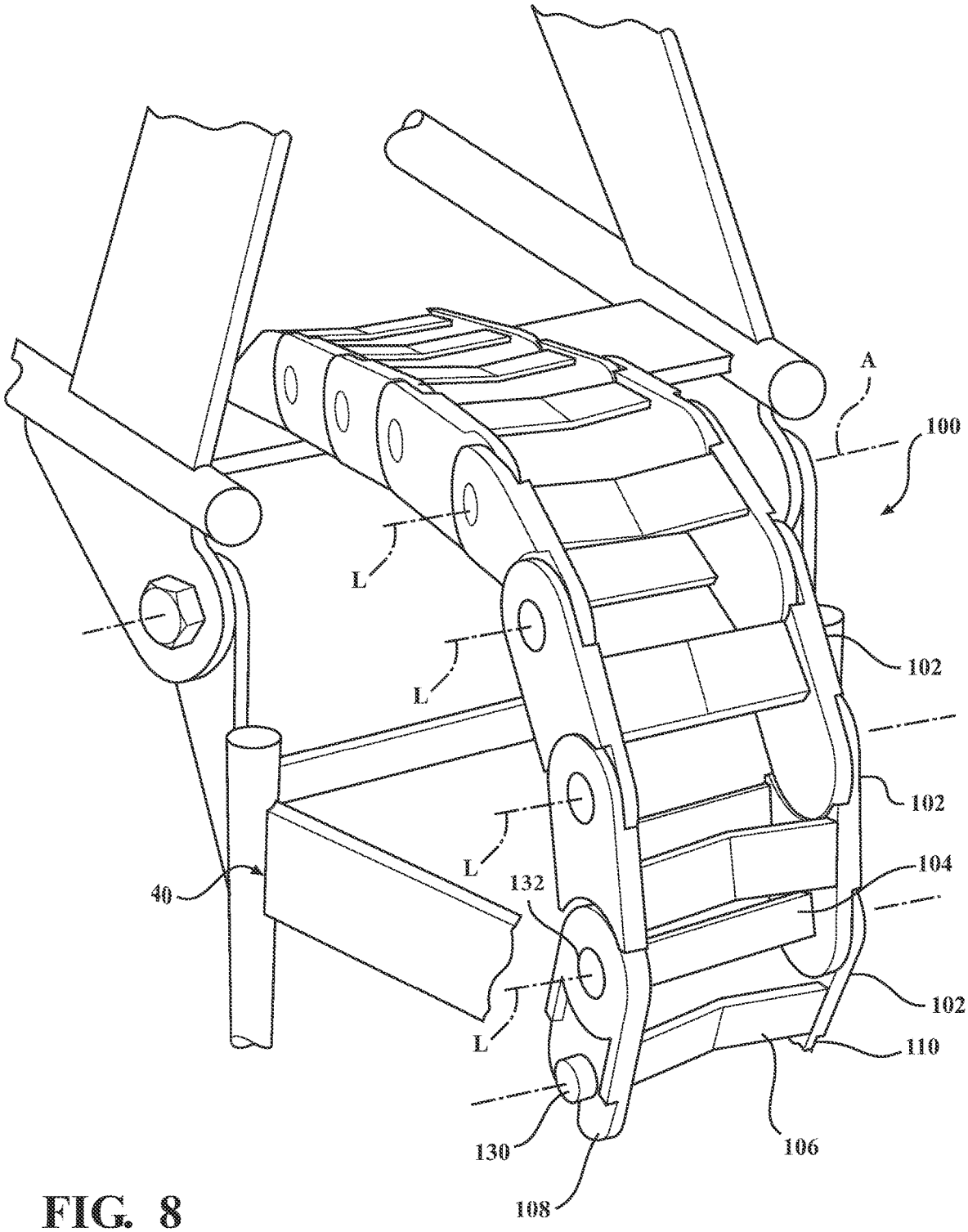
FIG. 8 is a perspective view of the flexible cable guide link assembly in a flexed condition as would be when the hinged lattice tower structure is hinged.

With reference to FIG. 8, the flexible cable guide link assembly 100 may be manufactured of a non-metallic material such as Fiberglass Reinforced nylon to further insulate the one or more cables C1-Cn such as the HUBBELL—HUBW HCT162341 cable track manufactured by Hubbell Incorporated, Shelton, Connecticut, USA.

In one embodiment, the flexible cable guide link assembly 100 is attached to the tower lattice section 42 at the first horizontal 59 above the axis A of the hinge assembly 60. The flexible cable guide link assembly 100 thereby will flex over the axis A of the hinge assembly 60 and rest on the horizontals 54 of the base lattice section 40.

The flexible cable guide link assembly 100 thereby protects the one or more cables C1-Cn from chaffing considerations that may otherwise be caused by the hinge assembly 60 and the horizontals 54, 59.

In one embodiment, the flexible cable guide link assembly 100 includes multiple rectilinear shaped links 102 that each have a back surface 104 and top surface 106 between respective side surfaces 108, 110. The side surfaces 108, 110 each define a pivot axis L formed by a respective stud 130 and divot 132 arrangement that permits the multiple rectilinear shaped links 102 to articulate a predetermined distance and thereby protect the one or more cables C1-Cn routed therethrough. Applicant has determined that the flexible cable guide link assembly 100 significantly protects the one or more cables C1-Cn during articulation of the tower lattice section 42 relative to the base lattice section 40.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A hinged tower, comprising:

a base section that comprises a base lattice section that comprises a first leg, a second leg, and a third leg forming a triangular shaped base lattice section of the tower, the first, second and third leg each constructed of a galvanized steel;

a tower section hinged to the base section, the tower section comprises a tower lattice section hinged to the base lattice section, wherein the tower lattice section comprises a first, second and third leg each constructed of an aluminum;

a hinge assembly between the base section and the tower section, the hinge assembly defines a hinge axis about which the tower section hinges relative to the base section; and a flexible cable guide link assembly attached to the tower section such that the flexible cable guide link assembly extends across the hinge axis and into the base section;

a foot welded to each leg of the base lattice section, each foot having an aperture;

an inner gusset welded to each foot and the respective leg, the inner gusset extends toward an inner edge of the respective foot; and an outer gusset welded to each foot, the outer gusset extends toward the aperture of the respective foot.

2. The tower as recited in claim 1, wherein each outer gusset defines an angle with respect to an axis defined between a center of the aperture and a center of the respective leg.

3. The tower as recited in claim 2, wherein the outer gusset extends outward toward the aperture.

4. The tower as recited in claim 3, wherein the outer gusset defines an angle.

5. The tower as recited in claim 3, wherein the outer gusset defines an angle with respect to the axis.

6. The tower as recited in claim 5, wherein the angle is 28 degrees.

7. The tower as recited in claim 6, wherein the outer gusset extends for a length greater than the inner gusset with respect to the leg.

8. The tower as recited in claim 1, wherein the flexible cable guide link assembly is manufactured of a non-metallic material.

9. The tower as recited in claim 8, further comprising at least one cable that is routed through the flexible cable guide link assembly.

10. The tower as recited in claim 9, further comprising a piece of equipment mounted to the tower section, the at least one cable routed to the piece of equipment.

11. The tower as recited in claim 10, further comprising a top mast section mounted to the tower section, the piece of equipment mounted to the top mast section.

12. A hinged lattice tower, comprising:

a base lattice section that comprises a first leg, a second leg, and a third leg forming a triangular shaped base lattice section of the tower, the first, second and third leg each constructed of galvanized steel;

a tower lattice section hinged to the base lattice section, wherein the tower lattice section comprises a first, second and third leg each constructed of aluminum;

a hinge assembly between the base lattice section and the tower lattice section, the hinge assembly defines a hinge axis about which the tower lattice section hinges relative to the base lattice section;

a flexible cable guide link assembly attached to the tower lattice section such that the flexible cable guide link assembly extends across the hinge axis and into the base lattice section, wherein the flexible cable guide link assembly is manufactured of a non-metallic material;

a top mast section mounted to the tower lattice section;

a piece of equipment mounted to the top mast section; and a cable routed to the piece of equipment through the flexible cable guide link assembly.

13. The tower as recited in claim 12, further comprising:

a foot welded to each leg of the base lattice section, each foot having an aperture;

an inner gusset welded to each foot and the respective leg, the inner gusset extends toward an inner edge of the respective foot; and an outer gusset welded to each foot, the outer gusset extends toward the aperture of the respective foot.

14. The tower as recited in claim 12, wherein the flexible cable guide link assembly is attached to the tower lattice section at a first horizontal above the axis of the hinge assembly.

* * * * *